US005964114A

United States Patent [19]

Noé et al.

[11] Patent Number: 5,964,114

[45] Date of Patent: Oct. 12, 1999

[54] METHOD OF REGULATING THE STRESS DISTRIBUTION IN METAL STRIPS OR SHEET, ESPECIALLY OF NONFERROMAGNETIC METALS

[75] Inventors: Rolf Noé ; Andreas Noé , both of Mülheim, Germany

[73] Assignee: BWG Bergwerk- Und Walzwerk-Maschinenbau GmbH, Duisburg, Germany

[21] Appl. No.: 09/076,928

[22] Filed: May 13, 1998

[30] Foreign Application Priority Data

May 13, 1997 [DE] Germany ..... 197 19 994

[51] Int. Cl.[6] ..... B21B 37/58; G01B 13/22

[52] U.S. Cl. ..... 72/54; 72/9.1; 72/11.7; 72/56

[58] Field of Search ..... 72/9.1, 11.7, 54, 72/200, 202, 56

[56] References Cited

U.S. PATENT DOCUMENTS

| | | | |
|---|---|---|---|
| 3,850,024 | 11/1974 | Ando et al. | 72/9.1 |
| 4,054,043 | 10/1977 | Eibe | 72/202 |
| 4,405,386 | 9/1983 | Mravic et al. | 72/200 |
| 5,755,128 | 5/1998 | Tippens et al. | 72/202 |
| 5,782,177 | 7/1998 | Rindfleisch | 72/240 |

OTHER PUBLICATIONS

"Control Method for Tension of Metal Strip", 62–130961 (A)—Abstract, Nippon Steel Corp (72), Jun. 13, 1987 JP.

"Rolled Strip Flatness Conrol Unit–Has Thyristor Frequency Converter . . . ", SU 1585–040–A—Abstract, Kiev Poly (Novo), Sep. 13, 1988 SU.

"Preventing Method for Meandering of Metal Strip", 62–13059 (A)—Abstract, Nippon Steel Corp.(72), Jun. 13, 1987.

*Primary Examiner*—David Jones
*Attorney, Agent, or Firm*—Herbert Dubno

[57] ABSTRACT

A strip line or line for processing nonferrous metal sheets and plates has linear motor stators provided for contactless adjustment of the tension or stress distribution in response to planarity and profile measurements.

13 Claims, 5 Drawing Sheets

METHOD OF REGULATING THE STRESS DISTRIBUTION IN METAL STRIPS OR SHEET, ESPECIALLY OF NONFERROMAGNETIC METALS

FIELD OF THE INVENTION

The present invention relates to a method of controlling the stress (tension) distribution in metal strip or sheets (plates), especially of nonferromagnetic materials and particularly of nonferrous metals. The invention is, more specifically, directed to such control during continuous strip processing in strip processing lines where, over one or more segments of such a line, linear motors with stator and armature are provided and the stator is oriented in the transverse or longitudinal direction with reference to the travel direction of the metal strip or sheet workpiece functioning as the armature. Such systems allow the stress or tension in the strip or sheet to be raised or lowered in the longitudinal and/or transverse direction in a contactless manner.

BACKGROUND OF THE INVENTION

Various possibilities for altering the stress or tension distribution in metal strip have been described in the literature. One such practical technique utilizes stretch bend leveling in which the continuously travelling metal strip is subjected to plastic deformation in the longitudinal and transverse direction by passing it through an array of rollers which are so oriented that the strip is bent in one direction and in opposite direction as it passes through the roller array.

Transverse curvature can be eliminated or ameliorated and metal strip which could be considered out of level can be leveled, i.e. made planar.

In stretch bend leveling, the stretch bend leveling rolls are pressed to a lesser or greater degree into the plane of travel of the metal strip. The tension applied in stretch bend leveling can be adjusted, for example, by the depth of penetration of the stretch bend rollers into the path.

The problem with stretch bend leveling, of course, is that the stretch bend rollers are always in contact with the opposite surfaces of the metal strip and this contact can have a detrimental affect on the surface quality of the product. For example, it cannot be excluded in the course of stretch bend leveling that dirt and contaminants can pass between the stretch bend rollers and the surface treated and can be pressed into the surface of the strip and thereby contribute an undesirable roughening thereto. Furthermore, a highly sensitive and accurate adjustment of the stress distribution is expensive with the stretch bend leveling system.

A stress distribution control system utilizing linear motors is described, for example, in the Soviet publication SU 1585040-A. The stress distribution is controlled, in this system, for a continuously travelling metal strip, by means of three linear motors. How the stress distribution of the travelling strip is detected, however, is not described in detail here nor is a reaction to different types of stress distribution possible with this system.

The same applies to the control purposes described in JP 62-130961A for influencing the stress in a metal strip. Linear motors are here provided on both sides of the metal strip which is maintained under tension between tension rollers. The strip travel is stabilized with this system.

To generate transverse movements with respect to the continuously travelling metal strip, linear motors are described in the Japanese Patent Document JP 62-130959.

The goal with this system is to largely eliminate or reduce the meandering of the continuously travelling strip and thus to suppress transverse curvature.

OBJECTS OF THE INVENTION

It is, therefore, the object of the invention to provide a process for affecting the stress or tension distribution in metal strip or plates, sheet or slabs of especially nonferromagnetic material which is particularly suitable in the case of strip processing lines in which varying or alternating stress distributions occur and which automatically and without delay at a minimum capital cost can effect suitable control.

It is also an object of this invention to provide an apparatus which is especially suitable for carrying out the improved method.

It is yet another object of the invention to provide an improved method of controlling the stress distributions in metal strip, sheet, plates or slab of nonferrous metals, whereby the drawbacks of earlier systems as described above can be avoided.

SUMMARY OF THE INVENTION

To achieve these objects, according to the invention, the stress or tension distribution in the metal strip or sheets (plates) of nonferromagnetic material, i.e. nonferrous metal, is detected in the course of a strip profile measurement and/or a planarity measurement and the electric power supplied to the stator and/or the current flow through the stator is controlled as a function of the measurement results to bring about a uniform stress or tension distribution and, consequently, in optimum planarity.

In other words with the aid of a control circuit, stresses and tensions in a metal strip or a metal sheet or plate can be compensated. This, of course, requires the measurement of the stress distribution. For this purpose, optical or mechanical measuring devices can be used which detect the strip or sheet profile over the strip or sheet width.

An example of such a measuring device is a socalled shape meter roller, i.e. a device which effects a mechanical sensing of the strip upper surface or the strip lower surface to detect the strip stress distribution over the width of the strip and which effects a feedback for optimum planarity.

In practice, it is found that regions of greater thickness correspond to regions of reduced longitudinal stress (tension) and regions of lesser thickness correspond to regions of greater longitudinal stress (tension). From such measurements, the stress distribution prevailing in the strip can thus be determined with relatively greater accuracy. This also applies to measurements taken on curved (cambered) or corrugated strip since the contours effectively reveal the stress or tension distribution.

The stator can apply additional tension or compression in the longitudinal or transverse direction, depending upon the current flow direction through the induction coil of the stator and the electrical power thereof to render the stress distribution uniform over the breadth of the strip or sheet and thus achieve an optimal planarity.

The invention is based upon the fact that an induction coil in a stator, utilizing principles of electrical linear motors or LIMs can generate stresses or tensions in a travelling metal strip or sheet or plate, when the latter forms the armature in a contactless manner so that no detrimental surface effect on the metal strip or plate need be feared.

The linear motor effect operates in a manner similar to that of asynchronous electronic motors in applying forces to the strip or plate travelling past the stator and that is the case when the stator is energized by an alternating current which would normally electromagnetically drive a rotor. In the case of a linear motor, the alternating field applies electromagnetic source to the armature, in this case the strip or sheet and the reaction between the electromagnetic induced in the strip or sheet and the stator field can contribute increased tension or compression in the travel direction to the strip or tension or compression in a transverse direction depending upon the orientation of the stator.

The stress which is contributed by the stator is a function of the electric power supplied and the direction of current flow through the stator and the stress effect depends both upon the current flow direction and the field orientation direction. When the stator field is aligned with the travel direction of the metal strip or sheets, an additional tension is produced in the metal strip or sheets in the region of the linear motor.

If the travel direction and the direction of the stator field are opposed, then a compression is generated which opposes the tension on the strip which is applied to transport the latter. As a result, in the longitudinal direction the strip stress can be increased or decreased in the region of the linear motor.

Of course, similar effects apply transversely to the travel direction and any direction in between, depending upon the orientation of the stator and the current flow direction, the strip stress can be controlled at any angle between 0° and 360° with the travel direction.

It has been found to be advantageous to provide each of the linear motors which are used according to the invention with at least two stators oriented with a predetermined separation between them, i.e. gap width, above and below the traveling metal strip or the metal sheets or plates.

The metal strip of sheets and plates thus travel through the gap with an adjustable distance from the stators. The workpiece is here an armature of nonferromagnetic material and, since it lies between two stators, tends to center in the gap and does not require electronic control means to adjust the floating state of the workpiece with respect to a single stator as a consequence of a symmetry of the magnetic forces, i.e. the forces resulting from the interaction between the eddy currents generated in the workpiece and the magnetic field of the stator.

With a single stator effective from one side, adjustment of the gap between the stator and the workpiece is required to effect a certain retardation by the stator of the workpiece or contribution of stress thereto.

When, of course, two stators are provided and flank the workpiece from either side, the workpiece tends to float between the stators. It will be understood that such a floating state can also be achieved by providing the metal strip or metal sheet so that it has a coating on its backside of a ferromagnetic material. In this case there is an equalization between the repulsion forces as they arise in nonferromagnetic materials and the attractive forces resulting from the ferromagnetic coating on the back.

This superimposition of forces, however, is basically theoretical since usually metal strip and metal plates of a single material are used.

This material is customarily entirely nonferromagnetic to achieve the desired floating state between the stators.

Suitable materials in this regard are nonferrous metals like aluminum or copper alloys.

More particularly, the method of the invention can comprise the steps of:

at least along one segment of the line juxtaposing a linear induction motor stator with the workpiece so that the workpiece forms and armature for the stator;

selectively orienting the stator relative to the travel direction longitudinally and transversely;

energizing the stator with electrical power and in a selected current-flow direction to contactlessly increase or lower workpiece stress selectively in a longitudinal and transverse direction;

detecting the stress distribution in the workpiece in the course of a strip profile or planarity measurement thereon; and controlling at least one of the power supplied to the stator and the current flow direction through the stator in dependence upon the measurement so as to impart a uniform stress distribution and improved planarity to the workpiece.

In summary, the invention enables a defined and targeted effect upon the stress or tension of a continuously travelling metal strip or series of metal plates and sheets in a controlled manner.

The stress distribution and the applied tension or compression is generated by the electric power supplied to the stator and/or by selection of the current flow direction thereto. It is possible, in accordance with the invention, to vary the current, the voltage and the frequency of excitation of the stator alone or in combination. It will be self understood that the direction of the stator field and thus the current flow direction can be varied in addition. This can be achieved by providing the stator with a plurality of coils arranged one behind the other and energized in a certain sequence, i.e. the flow direction through the successive coiled being regulated. In this manner, the targeted tension and compression in the region of the linear motor can be established for the respective workpiece or workpieces.

It is possible, in accordance with the present invention, by control of the electric power and/or the current flow direction to produce a uniform stress distribution in the workpiece and thereby bring about an optimum leveling. Alternatively, the degree of planarity can be adjusted in accordance with subsequent process steps along the line so that any desired result can be achieved. For instance, the planarity adjusted by the invention can be produced in conjunction with rolling force control, roll bending control, stretch bending or stretch bend leveling, or like operations. In such cases, the same computer as may control other operations along the line can control the linear motors of the present invention or the controller for the stator or stators of the invention may be a separate computer.

The planarity adjustment in accordance with the invention may be additive to other leveling effects and indeed the stress distribution induced in the workpiece may anticipate stresses applied by later steps such as rolling, stretch bending and the like so that the resulting product at the conclusion of these steps has the desired uniformity of the stress distribution.

In any case, the additional tension or compression applied by the stator or stators of the invention should result, at the outlet side of the segment of the line provided with the stators in that the ultimate stress distribution following the other operations in the line is free from problems. The stress distribution can be such, therefore, that they are optimal in the workpiece for the subsequent mechanical stages or can be matched to the mechanical stress-producing or tension-producing steps which may follow.

It is also possible with the present invention to eliminate, compensate or correct sheet or strip longitudinal curvature and/or deviations of the center line of the metal strip or of the metal sheets from a middle line of the processing apparatus by increasing the strip tension utilizing a linear motor, as a function of the deviation from alignment of the center lines. The tension is increased on one side of the center line, it may be reduced at the opposite side of that center line by yet another stator.

The deviation of the center line curvature line of the work from the center line of the processing line can thus be corrected by a countervailing increase of the tension on one side of the center line and reduction of the tension on the opposite side of that center line or an increase in the compression force applied to that latter side.

This permits a very fine adjustment of the stress distribution, especially when a plurality of linear motors with respect stators are used and the stators are spaced apart across the width of the workpiece in the travel direction. The stators can be oriented to apply force in the transverse direction and will usually be so energized that they supply opposite forces in the transverse direction.

This permits, especially for thin sheet or thin metal strip, the straightening of corrugations therein and improved leveling of the strip.

In the case of thin metal strip, a phenomenon arises which is not dissimilar from the phenomenon which arises in the drawing of plastic films, namely, longitudinal folding resulting from tension differences. Such longitudinal folding is undesirable for further processing steps. With the system of the invention, using the stators, transverse forces can be provided to prevent or pull out such longitudinal folding.

The means for eliminating the edge corrugations and longitudinal folds can be provided upstream and/or downstream of trimming shears thereby insuring a higher precise trimming of the metal strip or sheet. The result is a trimmed product free from edge corrugations.

Finally, the system of the invention can so influence the stress distribution before and/or after process steps like rolling, leveling, strip bend leveling and the like which may be common in a strip processing line so that the final product has the optimum planarity.

Before each of the rolling stands, leveling units or stretch bend levelers or after each of them or both, linear motors according to the invention can be used and the system of the invention can be employed immediately upstream of a coiler or stator so that optimum planarity is achieved before the coiling of the product in the form of the strip or stacking of the sheets or plates. In that case again, immediately upstream of the coiler or sheet stacker, linear motors are provided in accordance with the present invention.

A segment of the processing line with a linear motor or a plurality of linear motors can be provided at any optional location along the processing line and preferably upstream and/or downstream of the rolling, leveling, stretch bending, trimming and/or coiling and stacking stations.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
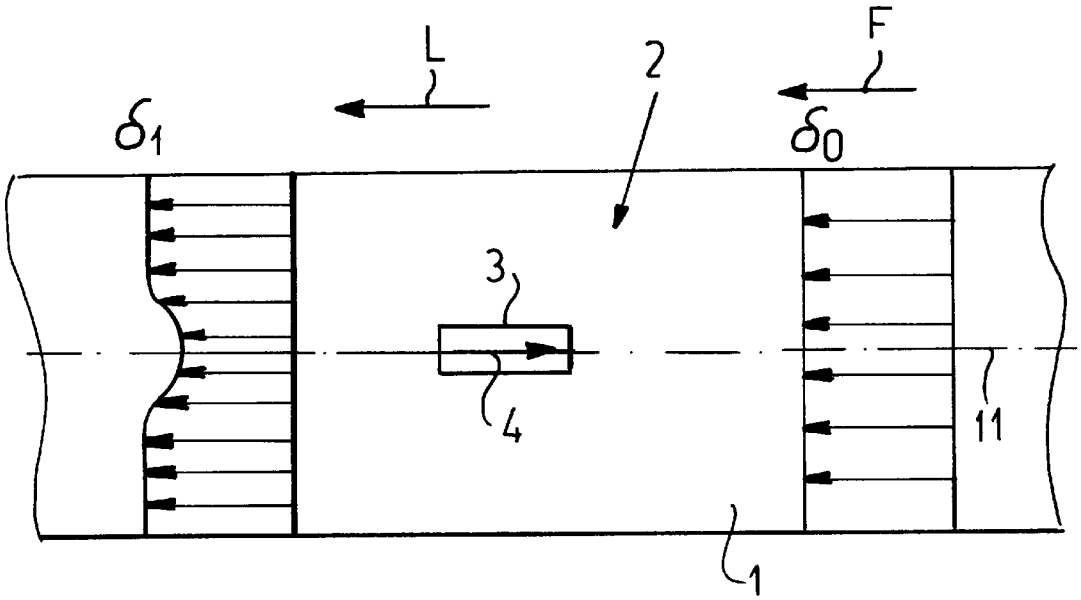
FIG. 1 is a plan view diagrammatically illustrating a processing line section showing the effect of a single linear motor.

FIG. 1 shows a continuously travelling metal strip 1 of a nonferromagnetic material, preferably aluminum strip, which is travelling through a segment 2 of a strip processing line which has not otherwise been illustrated in detail and in which a linear motor 3 is provided to displace the strip or simply to modify the stress distribution thereof.

Figure 8:
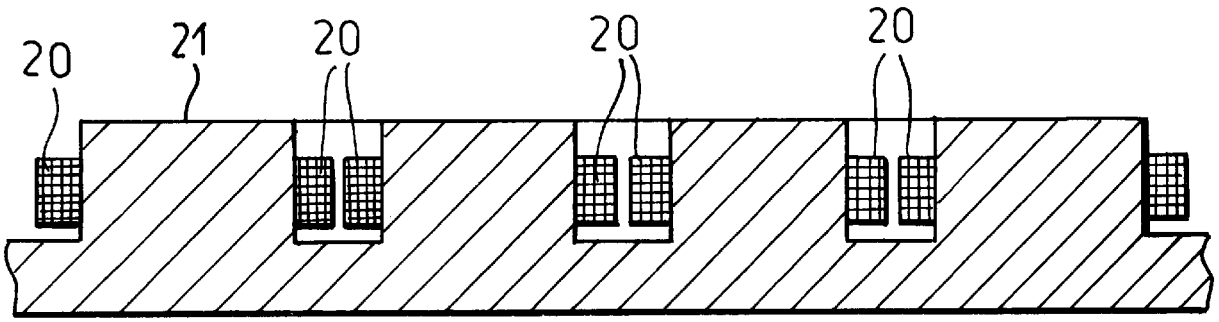
FIG. 8 is a cross section through such a stator taken along the line VIII—VIII of FIG. 7.

The linear motor 3 is formed by a stator or inductor 4 (FIGS. 7 and 8) which has coils 20 surrounding transverse teeth or pole pieces 21 so that the coils lie in slits between the teeth. The armature of the motor is the metal strip 1 which is the workpiece upon which the process line operates.

Of course, the workpiece may also be a metal sheet or slab. As the workpiece 1 travels past the linear motor 3, tension and/or compression can be generated in that workpiece, e.g. the metal strip 1.

Figure 2:
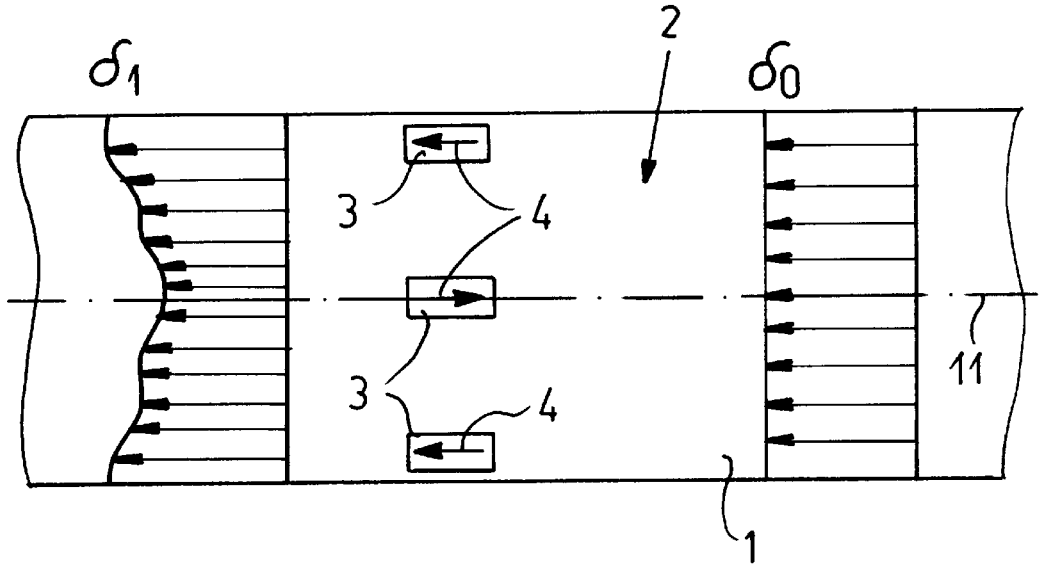
FIG. 2 is a diagram similar to FIG. 1 showing the effect according to the invention of two linear motors.
Figure 3:
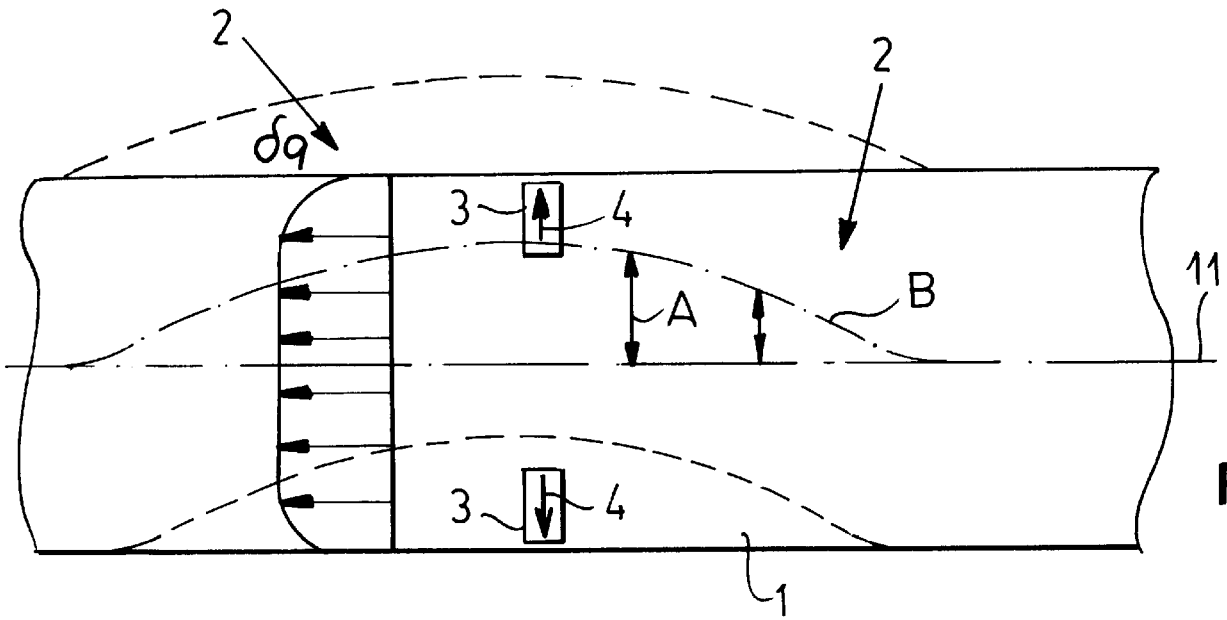
FIG. 3 is another diagram similar to FIG. 1 illustrating another aspect of the invention.

The stator 4 is oriented longitudinally of the travel direction L of the metal strip plate forming the armature (FIGS. 1 and 2), or transversely to this longitudinal direction (see FIG. 3).

By means of the electric power supplied to the stator 4 and/or the control of the current flow direction, within the processing line segment 2, the strip tension can be increased or decreased in the longitudinal direction and/or the transverse direction.

If it is assumed, for the sake of example, that the metal strip 1 is displaced by a tension force F in the direction L, e.g. through a friction driver such as a bridle or some other pair of rolls which are positively driven, a stress distribution is formed in the strip as represented in FIGS. 1 and 2 by the stress distribution $\delta_0$. This stress distribution in the case of FIG. 1 can be modified by the linear motor 3 which is here operated so that it generates a force counter to the force F and thus reduces the stress or tension in the region of the center. As a result, the stress distribution $\delta_1$ after passing through the segment 2 is generated. The tension is reduced in the region of the linear motor 3 since a tension of opposite sign has there been generated electromagnetically and this, of course, corresponds to a pressure or thrust in the direction opposite the application of the tensile force.

A similar effect is shown in FIG. 2. Here three linear motors 3 are disposed in the longitudinal direction L, namely, two outer linear motors and a central linear motor.

The two outer linear motors are so energized that they add tension in the direction of the displacement force application while the linear motor in the middle resists the tension.

In the embodiment of FIG. 1, when the tension is uniform between the outer edges and the center, since outwardly of the outer edges, the stress tends to cause the strip to curl. When the tension is reduced at the center and thus the net force is permitted to increase toward the outer edges, a flatter web is achieved without the tendency for longitudinal folding. A similar increase in net longitudinal tension between the center and the outer edges is provided in FIG. 2 in the stress distributions $\delta_1$ whereby a flatter web can be achieved. In FIG. 3, there is shown a system in which the stators 4 provide a transverse pull upon the strip generating the stress distribution $\delta_q$. The tension in the central region is here greater than at the very edges and the strip is pulled from the middle outwardly to prevent the formation of corrugations.

Figure 4:
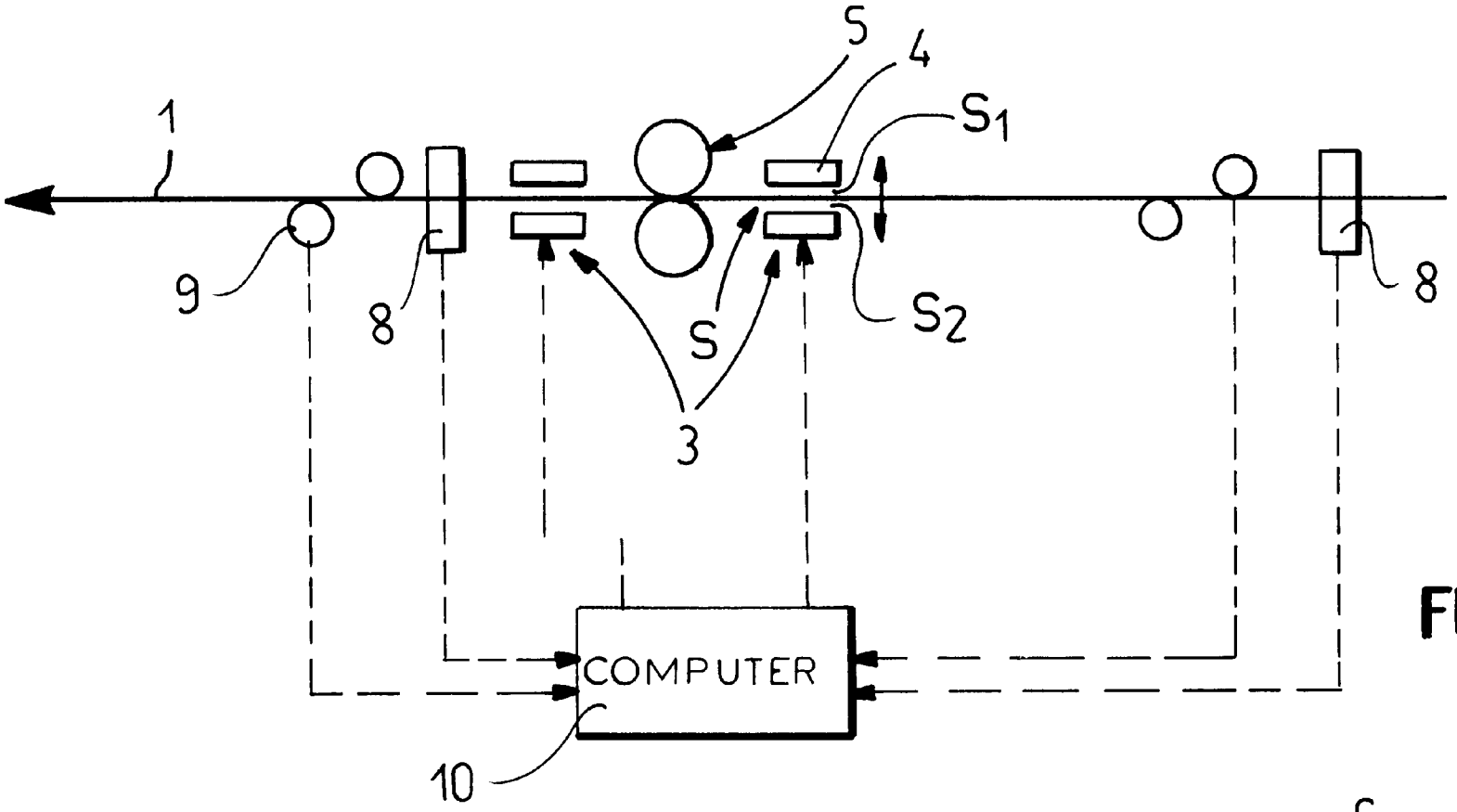
FIG. 4 is a diagram of a processing line for strip or metal stations according to the invention.
Figure 5:
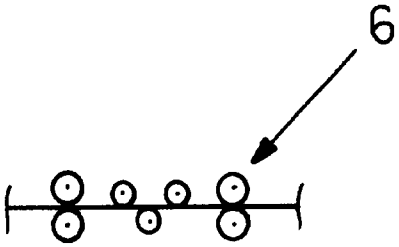
FIG. 5 shows a stretch bend leveler which can be used at an appropriate point along such a line.
Figure 6:
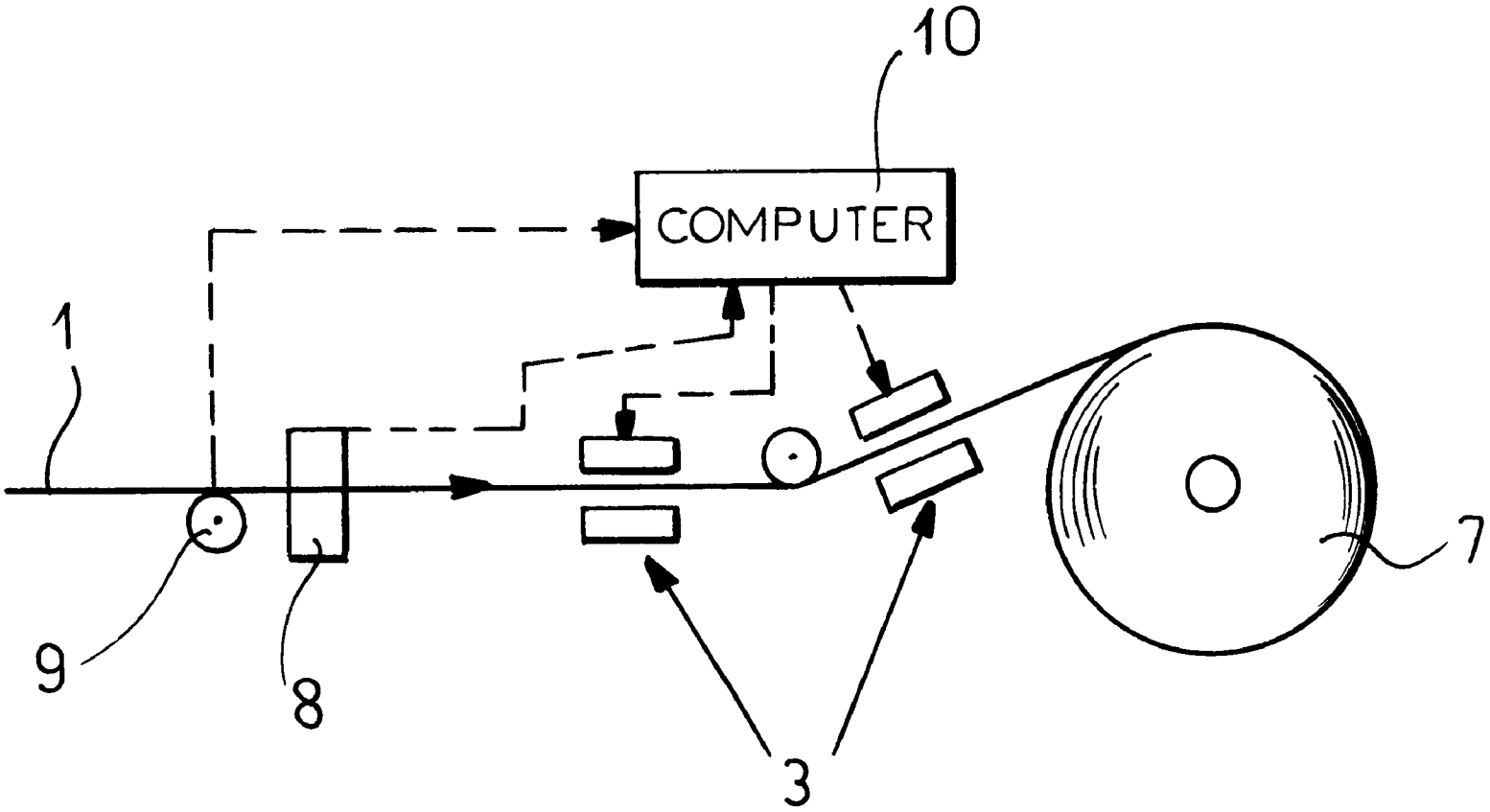
FIG. 6 is a diagram similar to FIG. 4 illustrating the use of linear motors in conjunction with a coiler.

Each linear motor 3 may have a counterpart on the opposite side of the strip as has been shown more clearly in FIGS. 4 and 6.

Thus each linear motor can comprise upper and lower stators 4 with a predetermined gap width S between them and through which the metal strip 1 or the workpiece plates can travel, the workpieces automatically adjusting to a spacing $S_1$, $S_2$ from the respective stators.

Because the metal strip is composed of aluminum, the eddy currents generated in the strip by the electromagnetic fields from the stators, result in a repulsion force between the workpiece and each of the stators, thereby centering the workpiece between the two stators. That balancing of the vertical forces is preferred. However, the vertical forces can be adjusted, by controlling the magnetic fields generated by the stators so that the distance $S_1$ and $S_2$ need not be equal and can be varied as may be desired. However, as a rule, it is preferred that the metal strip be free from net forces in the vertical direction during its entire travel through the gap S. It is also possible to adjust the magnetic fields so that stresses can be influenced in inclined directions, i.e. at any angle between 0° and 360° with respect to the travel direction L.

Where we have referred to a stress distribution, of course, we also mean a tension distribution, since the stator at each location also varies the tension applied to the workpiece along the longitudinal direction of that stator. Thus if the stator operates electromagnetically to apply thrust opposite to the tension during the workpiece along the path, a depression in the tension diagram across the width will be noticed in the region of the stator (center portion in FIGS. 1 and 2). Conversely, if the stator applies the electromagnetic force vector in the same direction as the applied tension, the tension diagram across the web will see an increased tension in those regions at which the electromagnetic tension contribution adds to the friction tension contributes (outer edges in FIG. 2).

The tension force or thrust or compression force which the stator 4 applies to the metal strip 1 can be adjusted, as noted, by varying the voltage applied to the stator, the current flow through the stator and optionally the frequency of the electric current applied, as well as the current flow direction. Both the applied current and voltage control the applied power and hence the electromagnetic force directly. Variation of frequency introduces a further variable. The current flow direction can determine whether a longitudinally oriented stator is acting in thrust or in tension. The current flow direction, of course, determines the direction of the stator field which is applied. This direction has been indicated by an arrow on the stator 4 L in FIGS. 1 through 3 as is a convention with linear motors. Current flow in effect here can be said to coincide with the arrow direction on the respective linear motor.

From FIG. 2 it will be apparent that the stress or tension distributions in the metal strip or sheets or plates forming the workpiece is measured and the electronic power supplied to the stator 4 and/or the current flow direction through the stator 4 is controlled depending upon the measurement results to obtain a uniform tension or stress distribution, for example, corresponding to optimum planarity. This is achieved in the system of FIG. 4 in combination with a rolling stand represented diagrammatically at 5 or a stretch bend leveler represented diagrammatically at 6 and which can be substituted for the roll stand in the line of FIG. 4. The stress or tension distribution can be adjusted upstream of or downstream of such processing operations as rolling and stretch bend leveling, or both and in the segments of the processing line, where the stress or tension distribution is to be adjusted, respective linear motors 3 and their stators 4 are provided.

In the embodiment of FIG. 4, two pairs of such linear motors 3 are shown upstream and downstream of the roll stand 5. The tension adjusting regions can be provided upstream and downstream of another type of leveler if desired. It is also possible using the principles shown in FIG. 4 to provide such linear motors 3 or stators 4 in the direction of travel upstream and/or downstream of a trimming shears i.e. shears for trimming the longitudinal edges of the strip and to use the inductive motors to generate different longitudinal tensions across the strip or sheet width to insure clean trimming of the workpieces.

FIG. 6 shows a system in which the induction motors are controlled by the computer 10 in the manner which has already been described, based upon planarity measurements from inputs 8, immediately upstream of a coiling station 7. The coiling station 7 represents any other final station of a strip line, for example, a stacking station for sheet or plate workpieces, a loading apparatus or the like.

Figure 7:
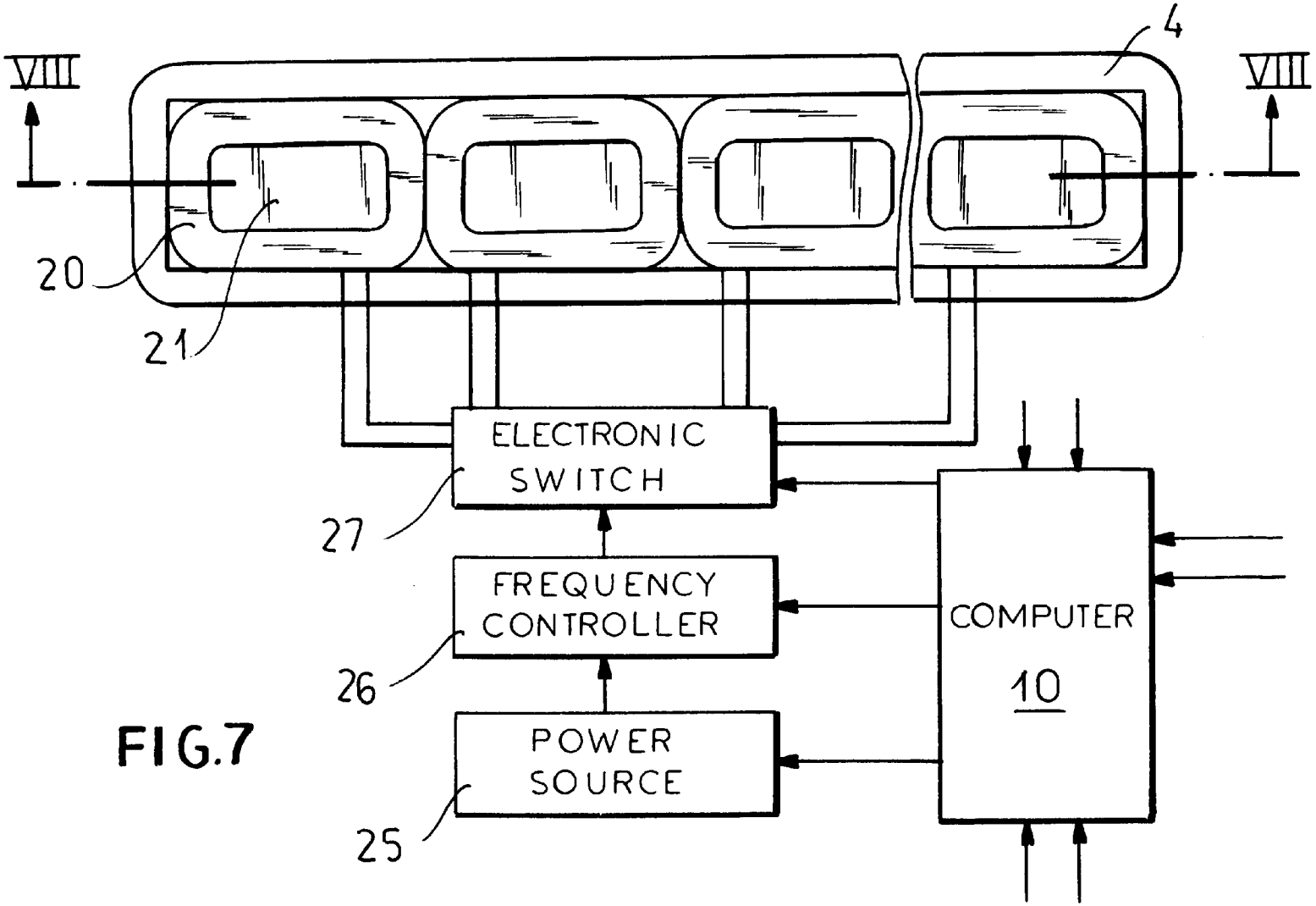
FIG. 7 is a diagram of a stator for use in the system of the invention.

From FIGS. 4 and 6, therefore, it will be apparent that the tension or stress distributions in the metal strip 1 or, more generally, the workpieces, is measured and utilizing the control circuit including the computer 10, the stators 4 or linear motors 3 are operated to bring about the desired thrust stress distributions by the control circuitry which can include a computer as has been shown at 10 in FIGS. 4, 6 and 7. For this purpose, profile or contour measuring units 8 are provided upstream and downstream of the roll stand 5 in FIG. 4 or upstream of the coiler 7 in FIG. 6. In addition, in the neighborhood of the contour measurement unit 8, planarity measurement rollers 9 may be provided. The profile or contour measurements 8 can be optical or mechanical sensors which serve to measure the profile of the travelling metal strip over its width. In any case, from the planarity measurement rollers 9 and the profile measuring units 8, signals representing the tension or stress distribution in the metal strip are obtained. These signals are evaluated in the electronic circuitry 10 and corresponding signals for operating the stators 4 are generated to yield the desired tension or stress distributions. As shown in FIG. 7, for example, the computer 10 can control a power source 25 for regulating voltage and current, a frequency controller 26 and an electronic switch 27 which determines the direction of flow of the current through the coils 20. The control is effected based upon the measurements contributed by the planarity measuring rolls and the profile measuring units. The control can be made more precise by monitoring of planarity and tension distributions immediately following the roll stand and providing a feedback to the electronic controller 10.

In addition, the power and/or current flow direction at the respective stators can be modified to anticipate subsequent process steps which may affect the tension or stress distribution and planarity, these steps including controlled rolling, roll bending, stretch bend leveling or the like so that, for example, at an upstream stage a completely uniform stress distribution is not provided but rather a preliminary stress distribution is achieved which, in combination with the further stages will ultimately yield the uniform final distribution.

With the process of the invention, it is possible to correct strip or sheet curvatures or cambers such as the deviation A of the center line B of the workpiece from the center line 11 of the processing line. This can be achieved by increasing the strip tension with one or more of the linear motors at one side of the center line while reducing the strip tension with one or more motors on the opposite side or by the system shown in FIG. 3 in which transverse stators are provided.

In the case of the system of FIG. 6, of course, the goal is to so adjust the planarity that the strip can be wound up cleanly and that clean stacking of plates or sheet are obtained.

We claim:

1. A method of controlling a stress distribution in a continuously traveling workpiece selected from the group which consists of metal strip or plates having a travel direction and during the travel of the workpiece along a strip-processing line, said method comprising the steps of:

at least along one segment of said line juxtaposing a linear induction motor stator with said workpiece so that said workpiece forms an armature for said stator;

selectively orienting said stator relative to said travel direction longitudinally and transversely;

energizing said stator with electrical power and in a selected current-flow direction to contactlessly increase or lower workpiece stress selectively in a longitudinal and transverse direction;

detecting the stress distribution in the workpiece in the course of a strip profile or planarity measurement thereon; and controlling at least one of the power supplied to said stator and the current flow direction through said stator in dependence upon said measurement so as to impart a uniform stress distribution and improved planarity to said workpiece.

2. The method defined in claim 1 wherein said linear induction motors stators are provided in pairs on opposite sides of said workpieces so that said workpiece travels through a gap between said stators with a variable distance $S_1$, $S_2$ from each of said stators.

3. The method defined in claim 1 wherein said control of power supply to said stator and current flow direction through said stator is effected for optimum tension distribution in said workpiece following a subsequent processing of said workpiece along said line in conjunction with rolling force control, rolling-roll bending, stretch bending and leveling.

4. The method defined in claim 1 wherein said stator corrects deviation of a center line of said workpiece from a center line of said strip processing line.

5. The method defined in claim 1 wherein along said segment a plurality of said linear induction motor stators are provided selectively longitudinally in said travel direction and transversely thereto.

6. The method defined in claim 5 wherein two of said stators generate tension on said workpiece transversely to said travel direction to drawout longitudinal folds in said workpiece.

7. The method defined in claim 5 wherein said segment includes a trimming shear and said stator is selectively located upstream and/or downstream of said trimming shear.

8. The method defined in claim 1 wherein said segment includes a rolling or leveling unit for said workpiece and said stator is selectively located upstream and/or downstream of said unit.

9. The method defined in claim 1 wherein said stator is provided upstream of a coiler or stacker is said workpiece.

10. An apparatus for controlling a tension distribution in a continuously travelling workpiece selected from the group which consists of metal strip or plates having a travel direction and during the travel of the workpiece along a strip-processing line, said apparatus comprising:

means for displacing said workpiece continuously in said travel direction;

a linear induction motor stator juxtaposed with said workpiece along with at least one segment with said stress processing line and selectively oriented longitudinally or transversely to said travel direction;

means for energizing said stator with electrical power and in a selected current flow direction to contactlessly increase or lower workpiece tension selectively in a longitudinal and transverse direction;

means for measuring the tension distribution in said workpiece and including a profile measuring unit and/or planarity measuring roller; and electronic control means responsive to said means for measuring for controlling said stator with corresponding signals to improve uniformity of the tension distribution.

11. The apparatus defined in claim 10 wherein said linear induction motor stator is one of a pair of said stators disposed on opposite sides of said workpiece and forming a gap between them through which said workpiece passes.

12. The apparatus defined in claim 11 wherein said segment includes a means for processing said workpiece selected from a trimming shear, a roller stand, a leveler and a stretch bender, respective linear motor stators being provided upstream and downstream of the respective means for processing.

13. The apparatus defined in claim 11, further comprising a terminal unit for collecting the workpiece at the end of said line, said stator being provided immediately upstream of said terminal unit.

* * * * *